US008851634B2

(12) United States Patent
Sasaki

(10) Patent No.: US 8,851,634 B2
(45) Date of Patent: Oct. 7, 2014

(54) LIQUID-JET HEAD, LIQUID-JET DEVICE, AND IMAGE FORMING APPARATUS

(71) Applicant: Takafumi Sasaki, Kanagawa (JP)

(72) Inventor: Takafumi Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/956,587

(22) Filed: Aug. 1, 2013

(65) Prior Publication Data

US 2014/0036007 A1 Feb. 6, 2014

(30) Foreign Application Priority Data

Aug. 2, 2012 (JP) ..... 2012-171999

(51) Int. Cl.
*B41J 2/05* (2006.01)
*B41J 2/175* (2006.01)

(52) U.S. Cl.
CPC ..... *B41J 2/175* (2013.01)
USPC ..... 347/66; 347/85

(58) Field of Classification Search
USPC ..... 347/54, 66, 67, 85
See application file for complete search history.

(56) References Cited

U.S. PATENT DOCUMENTS

| | | | | |
|---|---|---|---|---|
| 6,685,305 | B2 | 2/2004 | Okuda | |
| 7,192,132 | B2 * | 3/2007 | Suzuki | 347/94 |
| 7,469,993 | B2 * | 12/2008 | Murata et al. | 347/50 |
| 7,510,271 | B2 | 3/2009 | Owaki et al. | |
| 8,033,657 | B2 | 10/2011 | Sasaki | |
| 8,042,911 | B2 | 10/2011 | Sasaki | |
| 8,197,048 | B2 | 6/2012 | Yamanaka et al. | |
| 8,414,097 | B2 | 4/2013 | Sasaki | |
| 2007/0008388 | A1 | 1/2007 | Yamaguchi et al. | |
| 2013/0070018 | A1 | 3/2013 | Sasaki | |
| 2013/0176363 | A1 | 7/2013 | Sasaki | |

FOREIGN PATENT DOCUMENTS

| | | |
|---|---|---|
| JP | 2002-086721 | 3/2002 |
| JP | 2002-307676 | 10/2002 |
| JP | 3680394 | 8/2005 |
| JP | 2006-256006 | 9/2006 |
| JP | 2007-008108 | 1/2007 |
| JP | 2007-290295 | 11/2007 |
| JP | 2007-307774 | 11/2007 |

OTHER PUBLICATIONS

U.S. Appl. No. 13/949,589, filed Jul. 24, 2013.

* cited by examiner

*Primary Examiner* — Anh T. N. Vo
(74) *Attorney, Agent, or Firm* — Cooper & Dunham LLP

(57) ABSTRACT

A liquid-jet head includes nozzles disposed in a predetermined direction and configured to discharge a recording liquid, individual liquid chambers connected to the respective nozzles and configured to supply the recording liquid to the respective nozzles, a common liquid chamber connected to the individual liquid chambers and configured to supply the recording liquid to the individual liquid chambers, an air reservoir space disposed adjacent to the common liquid chamber and configured to retain air, a flexible division wall separating the common liquid chamber from the air reservoir space, a tube unit connected outside the liquid-jet head, a recording liquid supply tube passing through the air reservoir space to divide the air reservoir space into a plurality of spaces and configured to supply the recording liquid to the common chamber, and a connecting unit configured to connect the divided spaces to one another.

9 Claims, 12 Drawing Sheets

LIQUID-JET HEAD, LIQUID-JET DEVICE, AND IMAGE FORMING APPARATUS

BACKGROUND OF THE INVENTION

1. Field of the Invention

The disclosures discussed herein relate to a liquid-jet head configured to discharge a recording liquid such as ink, a liquid-jet device having the liquid-jet head, and an image forming apparatus having the liquid-jet device, such as an inkjet printer, a facsimile machine, a copier, or a multifunctional apparatus having a combination of these functions.

2. Description of the Related Art

An inkjet recording apparatus is generally known in the art as an image forming apparatus including a liquid-jet device having a liquid-jet head. The inkjet recording apparatus is configured to make a record on a sheet by discharging a recording material, namely, ink from the liquid-jet head onto the sheet. Such an inkjet recording apparatus may be able to record a high-precision color image on the sheet at a high speed. Note that the sheet indicated above is not limited to a sheet of paper, but includes any medium including an overhead projector (OHP) film to which a recording liquid such as ink is adhered. Such a medium may also be refereed to as a recording medium or a recording sheet. The inkjet recording apparatus has recently been utilized in an industrial system for a textile printer.

The liquid-jet head (e.g., see Patent Documents 1 to 7 noted below) mounted on the above-described inkjet recording apparatus generally includes a plurality of nozzle arrays, a plurality of individual liquid chambers connected to the nozzle arrays, and a recording material reservoir having a relatively large capacity, namely, a common liquid chamber connected to the individual liquid chambers.

The above-described liquid-jet head may be able to form any image on demand by selectively applying energy to the individual liquid chambers. The medium to which energy is applied may include a piezoelectric element, a heater tip, and the like.

It has become increasingly required for the liquid-jet head to be capable of outputting higher definition images at higher speeds. With respect to the former requirement, the number of nozzles and the density of the nozzles tend to increase while intervals between the individual liquid chambers are narrowed. In addition, the frequency of the energy application tends to become higher with respect to the former requirement. With respect to the latter requirement, an attempt has been made to increase a length of the recording head to provide a so-called line-type printer to cover the entire width region of the recording medium.

In focusing on a specific individual liquid chamber, a recording material inside the specific individual liquid chamber may receive a pressure change due to the energy applied to the individual liquid chamber. The pressure change may be propagated to the common liquid chamber. The pressure change not only affects the recording material inside the specific individual liquid chamber currently being focused on, but also consequently affects other recording materials inside the individual liquid chambers adjacent to the specific individual liquid chamber. The aforementioned effect may be called "mutual interference". The mutual interference may induce unintended liquid discharge or an unstable discharge status, which may disturb the formation of the high-definition image as an output result. Hence, there are disclosed various configurations of the liquid-jet head including a damper for suppressing the pressure change.

An example of the above configuration may be as follows. That is, the configuration of the liquid-jet head includes, as a damper, space parts containing air disposed adjacent to each other via a thin film, the space parts including a supply tube to supply a recording material to a common liquid chamber, and a narrow tube connecting the space parts to an external space of the liquid-jet head. The narrow tube is disposed so as to prevent the recording material inside the common liquid chamber from drying while causing the space parts to serve as a damper that restrictively connects the space parts and the external space.

With this configuration, even through such space parts are completely decoupled and each of the decoupled space parts further includes a plurality of separate spaces, the above-described narrow tubes may need to be disposed in each of the separate spaces of a corresponding one of the decoupled spaces. This may result in a complicated configuration and eventually raise the cost of production.

RELATED ART DOCUMENTS

Patent Document

Patent Document 1: Japanese Patent No. 3680394

Patent Document 2: Japanese Laid-open Patent Publication No. 2002-86721

Patent Document 3: Japanese Laid-open Patent Publication No. 2007-8108

Patent Document 4: Japanese Laid-open Patent Publication No. 2006-256006

Patent Document 5: Japanese Laid-open Patent Publication No. 2007-307774

Patent Document 6: Japanese Laid-open Patent Publication No. 2007-290295

Patent Document 7: Japanese Laid-open Patent Publication No. 2002-307676

SUMMARY OF THE INVENTION

Accordingly, it is a general object in one embodiment of the present invention to provide a liquid-jet head having a simplified configuration while maintaining a damper function of the common liquid chamber, a liquid-jet device having the liquid-jet head, and an image forming apparatus having the liquid-jet device. Examples of such image forming apparatus include an ink-jet printer, a facsimile machine, a copier, and a multiple function peripheral having these functions.

According to one aspect of the embodiment, there is provided a liquid-jet head that includes a plurality of nozzles disposed in a predetermined direction and configured to discharge a recording liquid; a plurality of individual liquid chambers connected to the respective nozzles and configured to supply the recording liquid to the respective nozzles; a common liquid chamber connected to the individual liquid chambers and configured to supply the recording liquid to the individual liquid chambers; an air reservoir space disposed adjacent to the common liquid chamber and configured to retain air; a flexible division wall separating the common liquid chamber from the air reservoir space; a tube unit connected outside the liquid-jet head; a recording liquid supply tube passing through the air reservoir space to divide the air reservoir space into a plurality of spaces and configured to supply the recording liquid to the common chamber; and a connecting unit configured to connect the divided spaces to one another.

The object and advantages of the invention will be realized and attained by means of the elements and combinations particularly pointed out in the claims.

It is to be understood that both the foregoing general description and the following detailed description are exemplary and explanatory and are not restrictive of the invention as claimed.

Other objects and further features of the present invention will be apparent from the following detailed description when read in conjunction with the accompanying drawings.

DESCRIPTION OF THE PREFERRED EMBODIMENTS

A description will be given of embodiments of the present invention, by referring to the accompanying drawings.

Figure 1A:
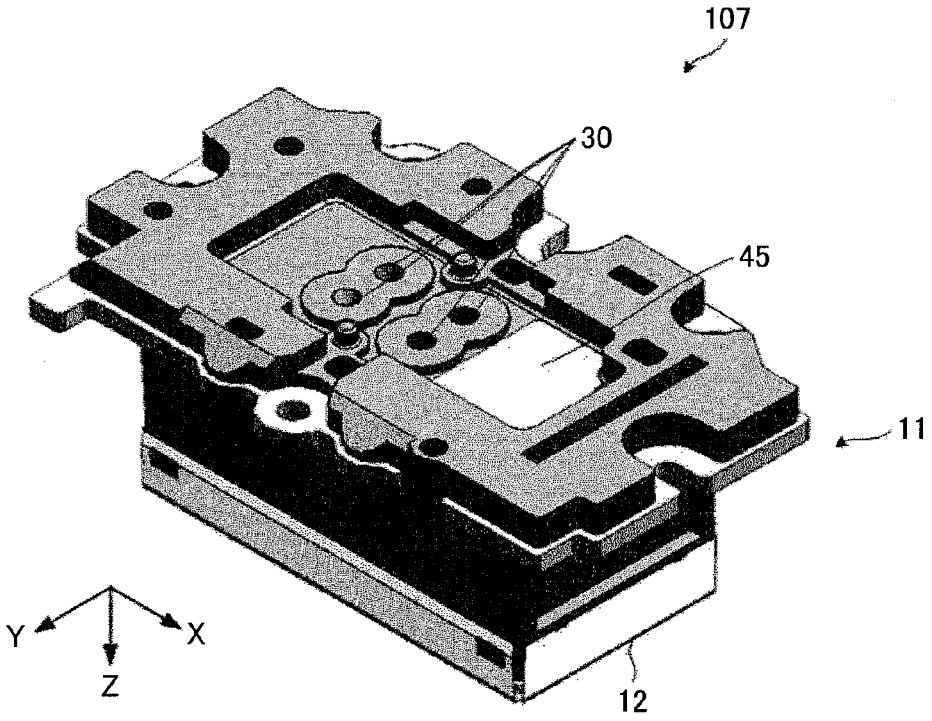
FIGS. 1A and 1B are perspective views illustrating an example of a liquid-jet head to which an embodiment of the invention is applied.
Figure 1B:
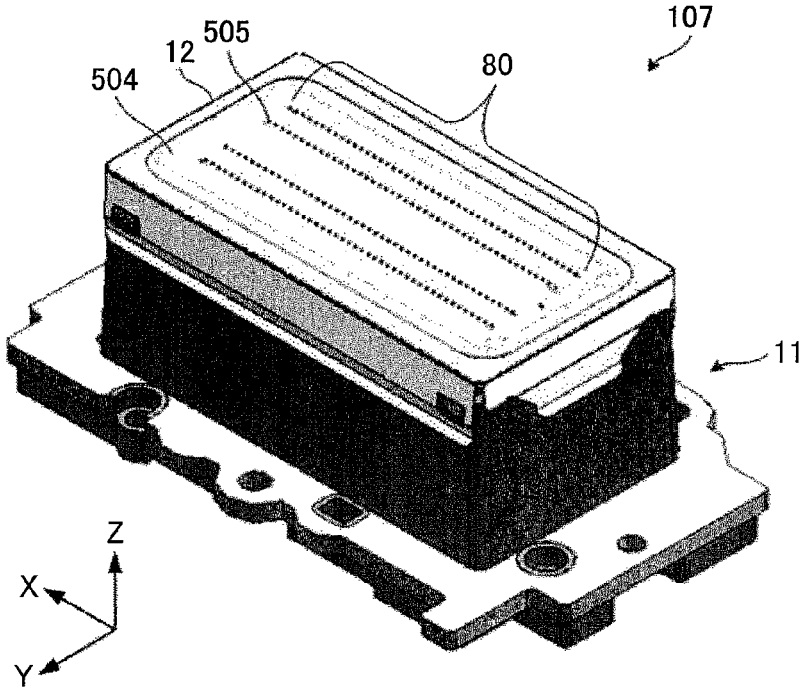

FIGS. 1A and 1B illustrate an example of a liquid-jet head to which an embodiment of the invention is applied. The liquid-jet head 107 includes a nozzle plate 504 forming an outer surface of the liquid-jet head 107, the nozzle plate 504 having a plurality of nozzles 505 configured to discharge ink serving as a recording liquid of a recording material. Note that the discharged recording liquid form liquid droplets; however, the recording liquid droplets or liquid droplets may hereinafter be simply called a "recording liquid" or a "liquid" for convenience of illustration. The liquid-jet head 107 further includes a nozzle cover 12 for protecting an outer circumference of the nozzle plate 504, a housing 11 supporting the nozzle plate 504 via the nozzle cover 12, and an aluminum seal 45 attached to the housing 11.

Figure 2:
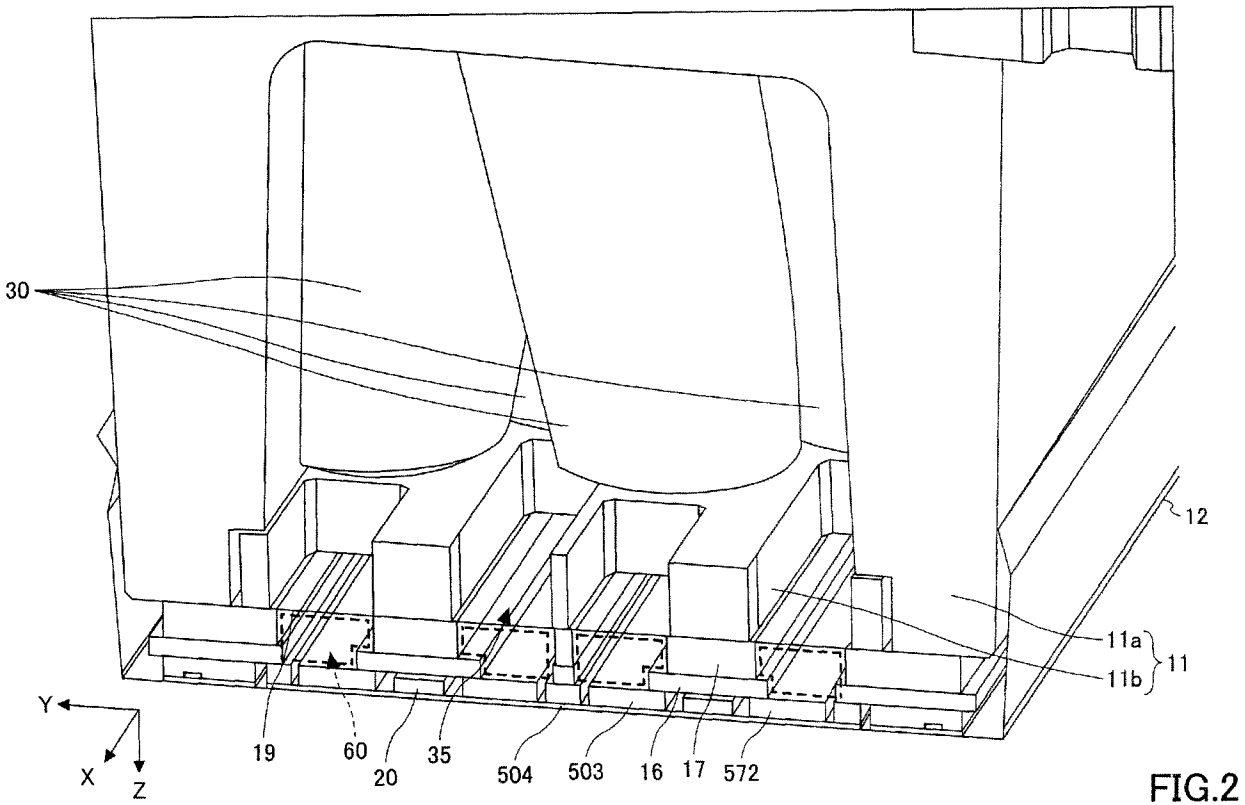
FIG. 2 is a perspective view illustrating a part of an internal structure of the liquid-jet head illustrated in FIGS. 1A and 1B.
Figure 3A:
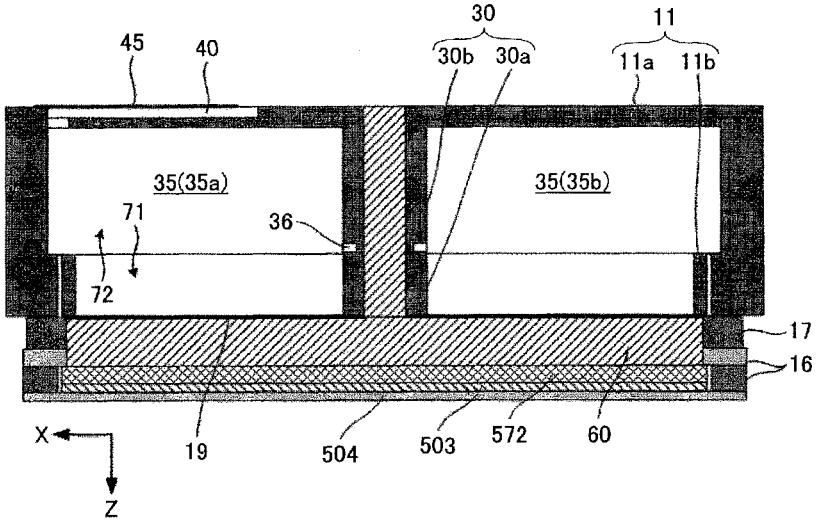
FIGS. 3A and 3B are schematic front sectional views illustrating a main part of the liquid-jet head illustrated in FIGS. 1A and 1B.
Figure 3B:
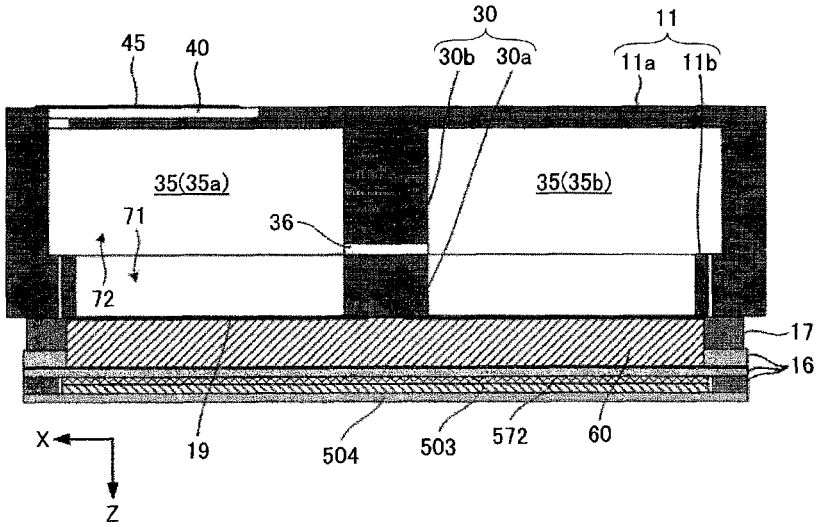

The liquid-jet head 107 further includes, as illustrated in FIG. 2, and FIGS. 3A and 3B, an actuator plate 503 serving as an actuator substrate of a pressure chamber substrate disposed inside the nozzle plate 504. The liquid-jet head 107 further includes a sub-frame 572 serving as a sub-frame substrate disposed as a base of the actuator plate 503, the sub-frame 572 being disposed at more inner side than the actuator plate 503. The liquid-jet head 107 further includes a common liquid chamber 60 having a part of its wall surface formed of a surface of the sub-frame 572 disposed opposite to the actuator plate 503 at more inner side than the actuator plate 572.

The liquid-jet head 107 further includes a recording liquid supply tube 30 formed of a part of housing and forming an ink supply pore to supply ink to the common liquid chamber 60, and a buffer chamber 35 disposed adjacent to the common liquid chamber 60 and serving as an air reservoir space retaining air. The liquid-jet head 107 further includes a film 19 serving as a poly(p-phenylene sulfide)(PPS) damper film functioning as a flexible division wall, the film 19 having a surface opposite to the buffer chamber 35 via the common liquid chamber 60 and the buffer chamber 35, the surface forming a part of the wall surface of the common liquid chamber 60.

The liquid-jet head 107 further includes a SUS backing plate 16 and a PPS backing plate 17 formed as an integral component by an insert molding process. The SUS backing plate 16 and the PPS backing plate 17 form a part of the wall surface of the common liquid chamber 60 in a similar manner as the sub-frame 571 and the film 19 forming a part of the common liquid chamber 60.

The liquid-jet head 107 further includes a drive IC 20 illustrated in FIG. 2 serving as a discharge control unit configured to control the nozzles 505 to discharge a liquid as a configuration integrally formed with the actuator plate 503. The liquid-jet head 107 further includes electromechanical converters 501 serving as piezoelectric elements illustrated in FIG. 4A driven by the drive IC 20 as a configuration integrally formed with the actuator plate 503. The liquid-jet head 107 further includes a diaphragm 540 sandwiched between the electromechanical converters 501 and the actuator plate 503, and configured to oscillate by being driven by the electromechanical converters 501.

The nozzle plate 504 is made of a SUS type stainless steel. The nozzles 505 are formed in the nozzle plate 504 by a press process to make holes in the nozzle plate 504.

As illustrated in FIG. 1, the nozzles 505 are disposed at 300 dpi along an X-axis direction matching the later-described sub-scanning direction illustrated in FIG. 10 so as to form nozzle arrays 80. The nozzle arrays 80 are disposed in four rows along a Y-axis direction matching the later-described main-scanning direction illustrated in FIG. 11.

Thus, the nozzles 505 forming the respective nozzle arrays 80 are disposed in the X-axis direction intersecting with the Y-axis direction, more specifically, orthogonal to the Y-axis direction. The nozzles 505 in each nozzle array BO include 320 pores such that a total number of 1280 pores with respect to the nozzles 505 in four rows are formed in the nozzle plate 504. A Z-axis direction illustrated in FIGS. 1A and 1B is a direction orthogonal to the X-axis direction and the Y-axis direction. Note that the X-axis directions, the Y-axis directions, and the Z-axis directions in FIGS. 1A and 1B are mutually matching directions. The four nozzle arrays 80 are configured to discharge ink with respective colors of yellow (Y), cyan (G), magenta (M), and black (Bk).

The housing 11 is made of resin. As illustrated in FIGS. 3A and 38, the housing 11 includes a body 11*a* disposed upstream of the Z-axis direction (i.e., in the minus Z-axis direction) and to which a seal 45 is attached, and a damper plate 11*b* serving as a fitting member fit in the body 11*a* to be integrated. The housing 11 supports the nozzle plate 504 by the body 11*a* via the nozzle cover 12 illustrated in FIGS. 1A and 1B downstream of the Z-axis direction (i.e., in the plus Z-axis direction) where the damper plate 11*b* is fitted in the body 11*a*.

The damper plate 11*b* includes pores 71 forming a part of the buffer chamber 35 downstream of the Z-axis direction (i.e., in the plus Z-axis direction). The damper plate 11*b* integrally includes the film 19 on a surface downstream of the Z-axis direction (i.e., in the plus Z-axis direction) of the damper plate 11*b* such that the pores 71 are sealed with the film 19. The damper plate 11*b* forms a part downstream of the Z-axis direction (i.e., in the plus Z-axis direction) of the recording liquid supply tube 30, and includes a tube part 30*a* serving as a first tube part coupled to the common liquid chamber 60 forming a part downstream of an ink flowing direction.

The body 11*a* further includes a recess part 72 forming a part upstream of the Z-axis direction (i.e., in the minus Z-axis direction) of the buffer chamber 35 and connected to the pores 71. The body 11*a* forms a part upstream of the Z-axis direction (i.e., in the minus Z-axis direction) of the recording liquid supply tube 30, and includes a tube part 30*b* serving as a second tube part forming a part upstream of the ink flowing direction.

Figure 5A:
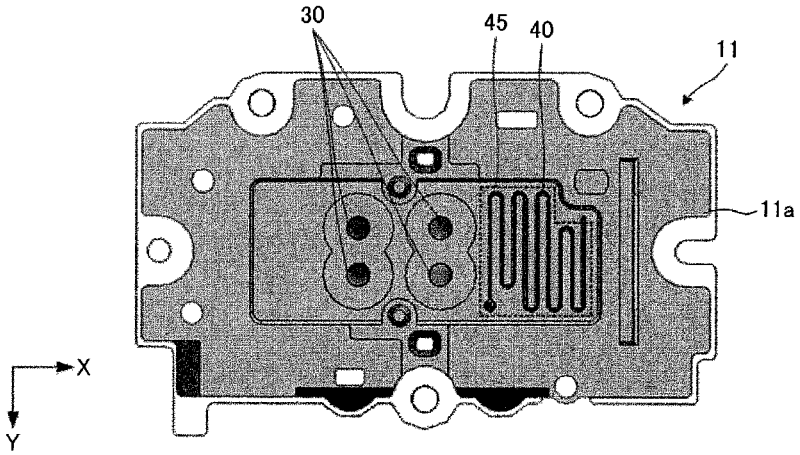
FIGS. 5A and 5B are plan views illustrating a part of the liquid-jet head illustrated in FIGS. 1A and 1B.
Figure 6A:
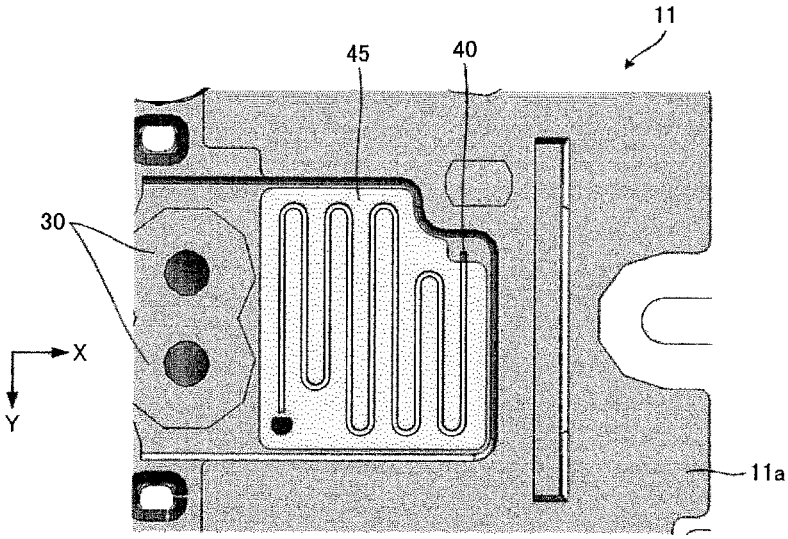
FIGS. 6A and 6B are enlarged views each illustrating another part of the liquid-jet head illustrated in FIGS. 1A and 1B.

The body 11*a* further includes a snake line 40 serving as a tube part coupling the buffer chamber 35 to an external part of the liquid-jet head 107 on a bottom part disposed at a side of the recess part 72 disposed opposite to the side connected to the pores 71. Note that in FIG. 5A, the seal 45 is indicated by a broken line illustrating an outline of the seal 45. However, in practice, the seal 45 is formed such that the seal 45 covers most of the snake line 40 partially excluding an end part. FIGS. 5A and 6A illustrate a state in which the body 11*a* is viewed from the upstream side of the Z-axis direction (i.e., the minus Z-axis direction) toward the downstream side of the Z-axis direction (i.e., the plus Z-axis direction).

The tube part 30*b* includes an end part upstream of the Z-axis direction (i.e., in the minus Z-axis direction), and the end part of the tube part 30*b* upstream of the Z-axis direction (i.e., in the minus Z-axis direction) is connected to a not-illustrated ink reservoir tank reserving ink. Note that in a case where the liquid-jet head 107 is installed in the image forming apparatus, the ink reservoir tank serves as a sub-tank 108, an ink cartridge in place of the sub-tank, or an ink cartridge together with the sub-tank 108 (see FIG. 10).

The tube part 30*b* includes an end part downstream of the Z-axis direction (i.e., in the plus Z-axis direction). When the damper plate 11*b* is fitted in the body 11*a*, an end part of the tube part 30*b* downstream of the Z-axis direction (i.e., in the plus Z-axis direction) is connected to the tube part 30*a*. Hence, the recording liquid supply tube 30 is formed by connecting the tube part 30*a* and the tube part 30*b*. In other words, the tube part 30*a* and the tube part 30*b* are connected to each other so as to form the recording liquid supply tube 30.

The tube parts 30*a* and 30*b* are both disposed in the middle in the X-axis direction, namely, disposed at a non-end part in the X-axis direction. Specifically, the tube parts 30*a* and 30*b* are both disposed in a middle location. Hence, the recording liquid supply tube 30 is formed in the middle in the X-axis direction, namely, disposed at a non-end part in the X-axis direction. Specifically, the recording liquid supply tube 30 is formed in a middle location.

Figure 5B:
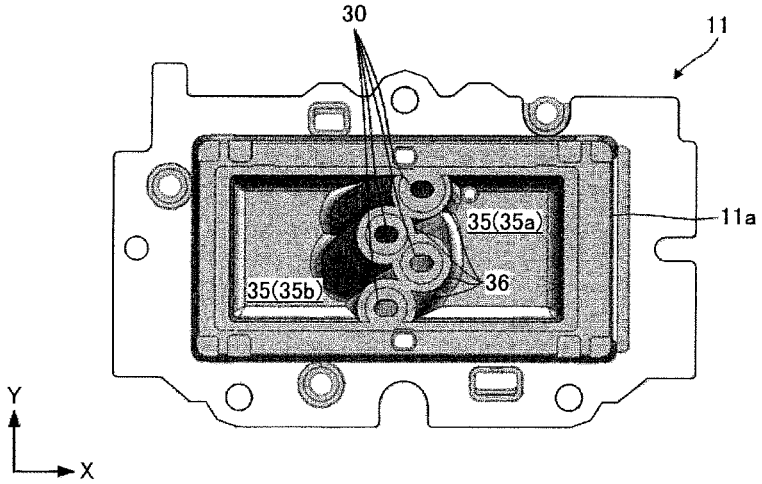
Figure 6B:
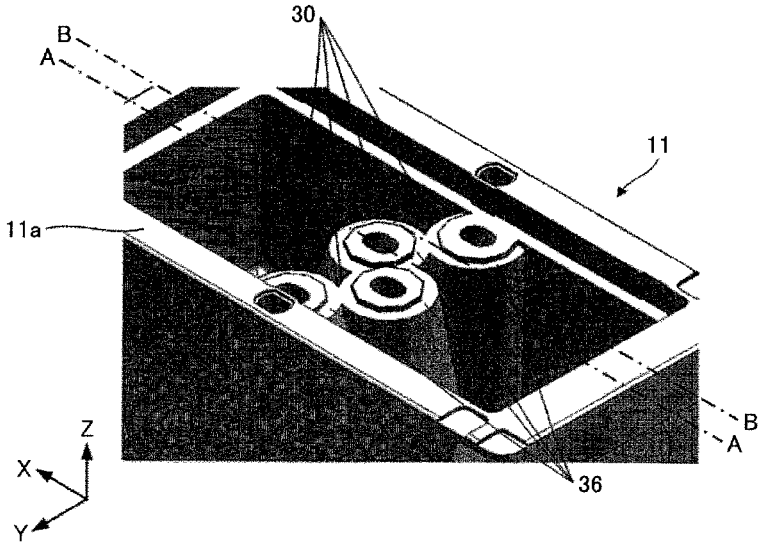

As illustrated in FIG. 5A, two recording liquid supply tubes 30 are disposed in each of the X-axis direction and the Y-axis direction at the end of the upstream of Z-axis direction. However, as illustrated in FIGS. 5B and 6B, two sets of the two recording liquid supply tubes 30, each set being disposed in the X-axis direction and the Y-axis direction, are alternately disposed near the middle part in the X-axis direction downstream of the Z-axis direction (i.e., in the plus Z-axis direction). Note that FIG. 5B illustrates a state in which the body 11*a* is viewed from the downstream side of the Z-axis direction (i.e., the plus Z-axis direction) toward the upstream of the Z-axis direction (i.e., the minus Z-axis direction). FIG. 6B is a perspective view of the state illustrated in FIG. 5B.

Hence, the two sets of the recording liquid supply tubes 30 are disposed in an inclined manner toward the downstream of the Z-axis direction (i.e., in the plus Z-axis direction), such that each set of the recording liquid supply tubes 30 is shifted in a corresponding one of the X-axis direction and the Y-axis direction. Then, though not illustrated in the drawings, the end part position downstream of the Z-axis direction (i.e., in the plus Z-axis direction) of each of the recording liquid supply tubes 30 formed of the tube part 30*b* disposed on the damper plate 11*b* is located in a straight line along the Y-axis direction and is also located in the middle position in the X-axis direction.

Hence, two sets of the recording liquid supply tubes 30 are shifted in positions of the X-axis direction and the Y-axis direction, respectively, at an inlet of ink connected to the ink reservoir tank and an outlet of the ink connected to the common liquid chamber 60. As a result, the two sets of the recording liquid supply tubes 30 are aligned at the outlet positions in the X-axis direction. This may be the resolution for minimizing an expensive head chip, that is, minimizing a chip area of the actuator plate 503 and the sub-frame 572.

Hence, the parts connected to the common liquid chamber 60 of the recording liquid supply tubes 30 are disposed at an approximately center in the X-axis direction of a longitudinal direction of a head chip. If such parts are disposed at one end part in the X-axis direction, the length toward the opposite end is increased. Hence, the substantive length of the common liquid chamber 60 is increased, which increases the inductance of this channel. Hence, the amplitude of the pressure change at ink discharge differs between the vicinity of the center and the vicinity of the end part in the X-axis direction, which may exhibit inconsistent discharge characteristics. However, in the liquid-jet head 107, the parts connected to the common liquid chamber 60 of the recording liquid supply tubes 30 are disposed at an approximately center in the X-axis direction. Hence, the above-described inconsistent discharge characteristics may be minimized.

As described above, the recording liquid supply tubes 30 having the above-described configuration and arrangement pass through the buffer chamber 35 serving as an internal space of the housing 11 in the X-axis direction, such that the buffer chamber 35 is divided into two spaces 35*a* and 35*b*, as illustrated in FIGS. 3A and 3B in this embodiment. The buffer chamber 35 includes the space 35*a* downstream of the X-axis direction (i.e., in the plus X-axis direction) and the space 35*b* upstream of the X-axis direction (i.e., in the minus X-axis direction) setting the disposed positions of the recording liquid supply tubes 30 as the boundaries in the Z-axis direction.

One end of the snake line 40 is connected to the space 35*a* as illustrated in FIGS. 3A and 3B. The snake line 40 is formed as a groove having the depth of approximately 300 μm and the length of approximately 70 mm in a meandering fashion in a surface part of the body 11*a*, namely, a ceiling surface of the body 11*a* that is exposed to the atmosphere or a space outside the liquid-jet head 107, as illustrated in FIG. 5A. The snake line 40 excluding a part in a meandering fashion, namely, the other end is sealed by the seal 45 to form a narrow tube. Accordingly, one end of the snake line 40 is connected to the space 35*a* and the other end of the snake line 40 is connected to the atmosphere.

The snake line 40 is disposed for the following reasons. The buffer chamber 35 serves as an air reservoir layer. However, when the buffer chamber 35 is enclosed to form an enclosed space, due to a change in an ambient temperature or an atmospheric pressure in an environment in which the liquid-jet head 107 is disposed, the volume of the buffer chamber 35 is changed further to change the compliance of the film 19. Hence, the buffer chamber 35 may need to be open to the atmosphere. The compliance indicates susceptibility to deformation and is defined by the reciprocal number of stiffness. However, when the buffer chamber 35 is open to the atmosphere without limitations, ink inside the common liquid chamber 60 evaporates due to moisture permeability in the film 19 formed of an extremely thin resin film, and ink viscosity rises to exhibit an adverse effect on the discharge characteristics. Hence, the snake line 40 is disposed in the ceiling surface of the housing 11 in order to prevent the above adversity because the snake line 40 serves as a narrow tube configured to communicate air between the buffer chamber 35 and the atmosphere.

With the above configuration of the snake line 40, the buffer chamber 35 is caused to be in communication with the atmosphere while suppressing the evaporation of the ink. Hence, the film 19 and the buffer 35 (specifically the film 19) are configured to function as the damper for the pressure change as will be described later.

Figure 4A:
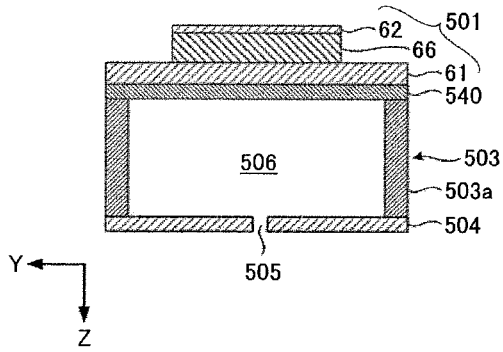
FIGS. 4A and 4B are schematic front sectional views each illustrating individual liquid chambers disposed in the liquid-jet head illustrated in FIGS. 1A and 1B.
Figure 4B:
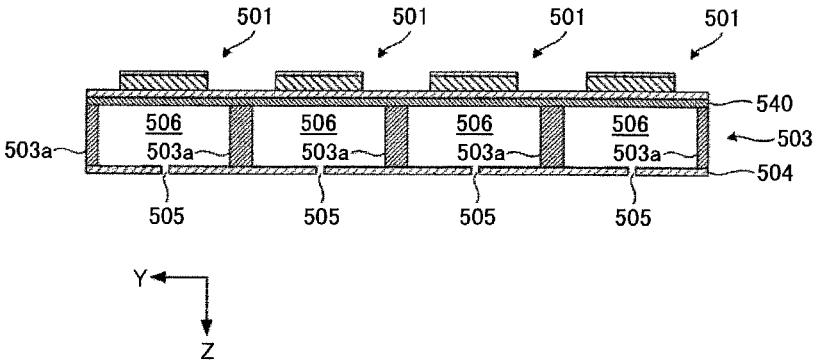
Figure 7:
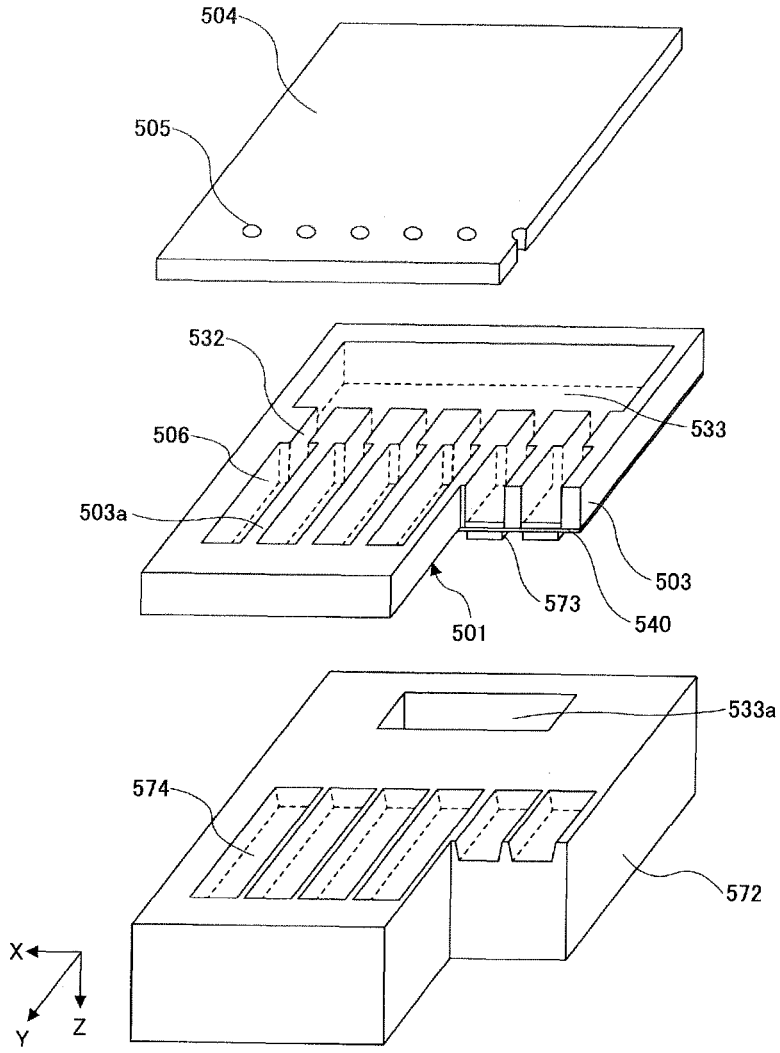
FIG. 7 is a schematic exploded perspective view illustrating nozzles and the individual liquid chambers disposed in the liquid-jet head illustrated in FIGS. 1A and 1B.

The actuator plate 503 is formed by etching a silicon (Si) substrate. As illustrated in FIGS. 4A and 4B, and FIG. 7, the actuator plate 503 is connected to each of the plural nozzles 505, and includes a plurality of individual liquid chambers 506 serving as pressure liquid chambers. The individual liquid chambers 506 are configured to supply ink to the respective nozzles 505.

The actuator plate 503 further includes division walls 503*a* configured to isolate adjacent individual liquid chambers 506. The actuator plate 503 further includes a connecting liquid chamber 533 connected commonly to first ends of the individual liquid chambers 506 as illustrated in FIG. 7. The individual liquid chambers 506 and the connecting liquid chamber 533 are formed by etching a Si substrate based on an etching process.

The sub-frame 572 is a plate member having a thickness of approximately 400 μm, which is formed by etching a Si substrate. The sub-frame 572 includes an ink passage part 533*a* serving as an ink supply port connected to the connecting liquid chamber 533 and the common liquid chamber 60 to pass the ink, and an electromechanical converter protecting space 574 configured to receive and protect the electromechanical converters 501. The sub-frame 572 further includes a not-illustrated opening configured to house the drive IC 20. The ink passage part 533*a*, the electromechanical converter protecting space 574, and the opening are formed by etching a Si substrate based on the etching process.

With the structures of the actuator plate 503 and the sub-frame 572, the common liquid chamber 60 is connected to each of the individual liquid chambers 506 via the ink passage part 533*a* and the connecting liquid chamber 533, such that the common liquid chamber 60 supplies ink to each of the individual liquid chambers 506.

As illustrated in FIGS. 4A and 4B, the electromechanical converter 501 is formed by layering a not-illustrated contact layer, a lower electrode 61, an electromechanical converter film 66, and an upper electrode 62 on the diaphragm 540 in this order based on a photolithography process. The diaphragm 540 is formed by depositing an approximately 2 μm-thick Si compound on the actuator plate 503 based on the CVD process.

The individual liquid chambers 506 and the electromechanical converters 501 corresponding to the nozzles 505 are disposed at 300 dpi in the X-axis direction based on the nozzles 505 being disposed at 300 dpi along the X-axis direction. The individual liquid chambers 506 and the electromechanical converters 501 corresponding to the nozzles 505 are disposed at 4 dpi in the Y-axis direction based on the nozzles being disposed at 4 dpi along the Y-axis direction. Similarly, the common liquid chambers 60 are disposed in four rows along a Y-axis direction as illustrated in FIG. 2.

The drive IC 20 is configured to select a drive signal transmitted to the liquid-jet head 108 via a not-illustrated electric wiring, and apply the selected drive signal to the electromechanical converter 501. A desired one of the electromechanical converters 501 may be driven and distorted by causing a corresponding one of the drive ICs 20 to switch the drive signal. The diaphragm 504 integrally formed with the electromechanical converters 501 is displaced based on the distortion of the desired one of the electromechanical converters 501 so as to change the volume of the individual liquid chamber 506 corresponding to the desired electromechanical converter 501. Consequently, pressure is applied to the liquid, namely, the ink inside the individual liquid chamber 506 so as to cause the nozzles 505 to discharge a liquid. Hence, the liquid may be discharged from the desired one of the individual liquid chambers 506.

The compliance of the film 19 absorbs and attenuates the pressure change generated by the drive of the electromechanical converter 501 and propagated from the individual liquid chamber 506 to the common liquid chamber 60. Mutual interference induced by the pressure change and propagated to ink inside the individual liquid chamber 506 may be prevented by a function serving as the damper function corresponding to the pressure change. Accordingly, unintended ink discharge due to the mutual interference or instability of discharge state may be suppressed or prevented. As a result, a high-definition image output may be acquired.

The film 19 is extremely thin and difficult to be handled, and hence, the film 19 is formed in the damper plate 11*b* as an integral component by an insert molding process. Preferable examples of the film 19 include a PPS (e.g., "TORELINA" produced by Tray industries Inc.) film, a polyimide (PI) film (e.g., "UPILEX" produced by Ube Industries, Ltd.), and the like. It may be important that these materials have wettability with respect to the recording material to be used such as ink. The wettability indicates a property of being insoluble in the recording material or a swelling property.

The thickness of the film 19 may preferably be in a range of 10 to 20 μm. The film 19 may be provided with a layer for preventing moisture permeability. Such a layer may, for example, be formed by sputtering metal such as Ti or Nb, or depositing a $SiO_2$ film. In the film 19 provided with such a layer, it may be possible to prevent an ink viscosity increase caused by the above moisture permeability. The film 19 is not necessarily a resin film, and may be a $SiO_2$ film or a metallic thin film deposited by the semiconductor process in view of allowing the film 19 to serve as the damper.

As already noted above, in the liquid-jet head 107, each of the recording liquid supply tubes 30 is disposed in the middle part of the X-axis direction, and the part of each recording liquid supply tube 30 connected to the corresponding common liquid chamber 60 is disposed approximately at the center of the X-axis direction. Hence, the common liquid chamber 60 is divided by the recording liquid supply tubes 30 in the X-axis direction so as to form the spaces 35*a* and 35*b*.

Figure 12:
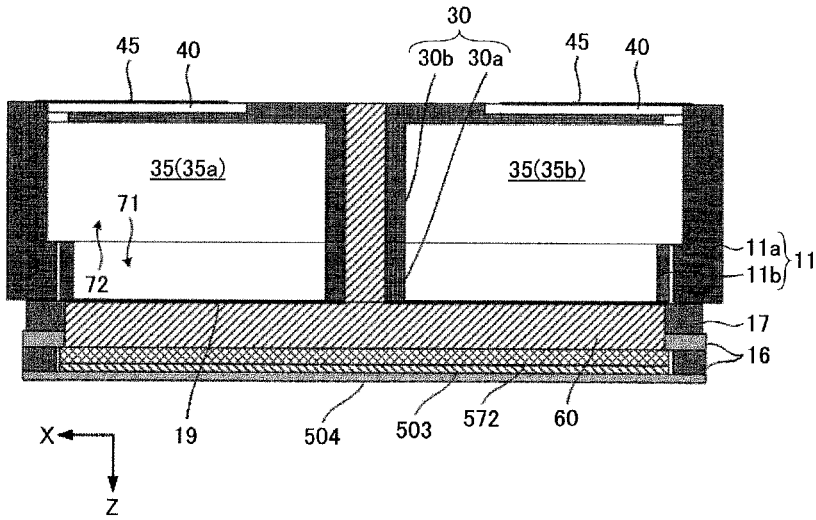
FIG. 12 is a schematic sectional view illustrating an example of a liquid-jet head having a problem to be solved.

Note that it is assumed that the spaces 35*a* and 35*b* are completely isolated independent spaces, which are formed by dividing the common liquid chamber 60. In this case, the snake line 40 and the seal 45 may need to be provided in each of the spaces 35*a* and 35*b*, as illustrated in FIG. 12. Such a configuration may provide a complicated structure in production, which may result in raising production cost.

The liquid-jet head 107 further includes, as illustrated in FIGS. 3A and 3B, FIG. 5B, and FIG. 6B, a connecting part 36 serving as a penetrating channel configured to cause the spaces 35*a* and 35*b* to be in communication with each other. Note that FIG. 3A is a schematic sectional view of the liquid-jet head 107 illustrating a ZX plane cut along a dash-dot line indicated by A-A in FIG. 6B, and FIG. 3B is a schematic sectional view of the liquid-jet head 107 illustrating a ZX plane cut along a dash-dot line indicated by B-B in FIG. 6B.

The connecting part 36 is a recess formed in the periphery of the middle part of each of the recording liquid supply tubes 30, such that the diameter of the middle part is reduced. The buffer chamber 35 forms one intact space without being divided by the connecting part 36 to connect between the spaces 35*a* and 35*b*. Accordingly, as already noted above, only the space 35*a*, which is one of the spaces 35*a* and 35*b*, includes the snake line 40 and the seal 95 in the liquid-jet head 107.

Hence, the complication of the structure of the liquid-jet head 107 may be avoided without raising the production cost by having only one combination of the snake line 40 and the seal 45 while securing the function provided by the snake line 40. Note that the snake line 40 and the seal 45 may alternatively be provided only in the space 35*b*.

Figure 8A:
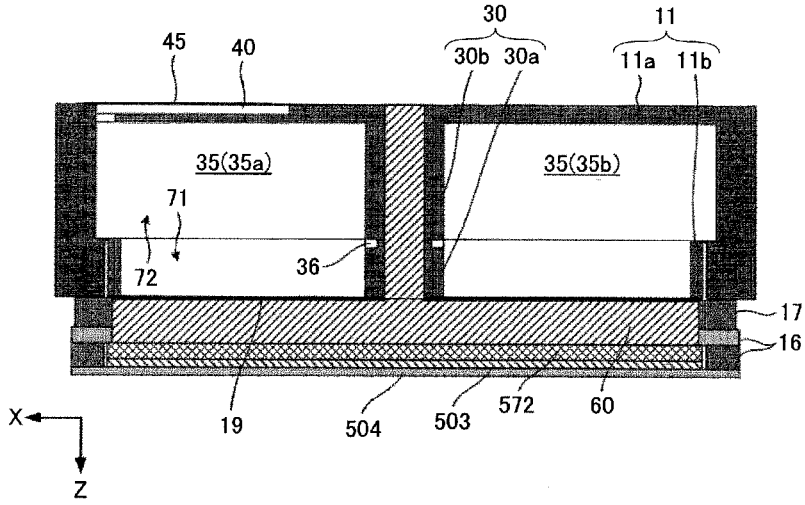
FIGS. 8A and 8B are schematic front sectional views illustrating a main part of another configuration example of the liquid-jet head illustrated in FIGS. 1A and 1B.
Figure 8B:
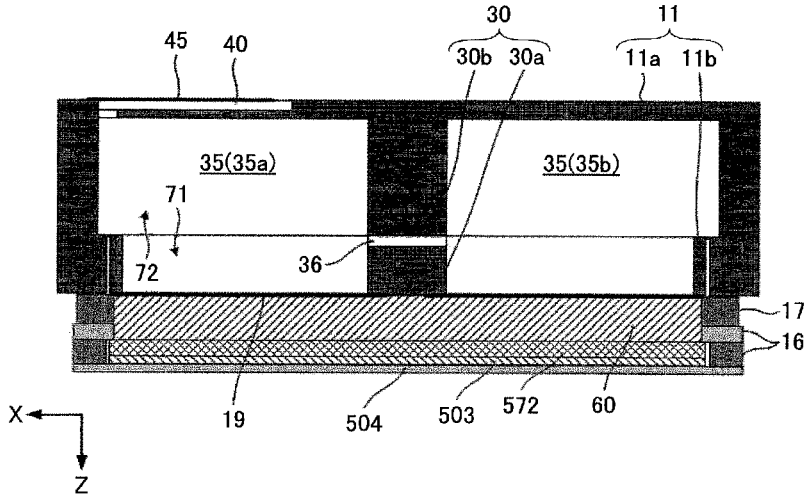

In this embodiment, each of the connecting parts 36 forms a step in the circumference of the tube part 30*b* in an end face of the tube part 30*b* connected to the tube part 30*a*. Hence, the connecting part 36 may be formed in a simplified process. As illustrated in FIGS. 8A and 8B, the step may alternatively be formed in an end surface of the tube part 30*a* connected to the tube part 30*b*. The step may, though not illustrated in the drawings, alternatively be formed in both of the tube parts 30*a* and 30*b*. That is, the step may be formed at least in one of the tube parts 30*a* and 30*b*.

Thus, the connecting part 36 may be simply set by providing the step formed in an end face of the tube part 30*a* and/or the tube part 30*b*. Note that the connecting part 36 may be formed of a recess disposed in the middle part of tube part 30*a* and/or the tube part 30*b* such that the diameter of the middle part is reduced.

Figure 9A:
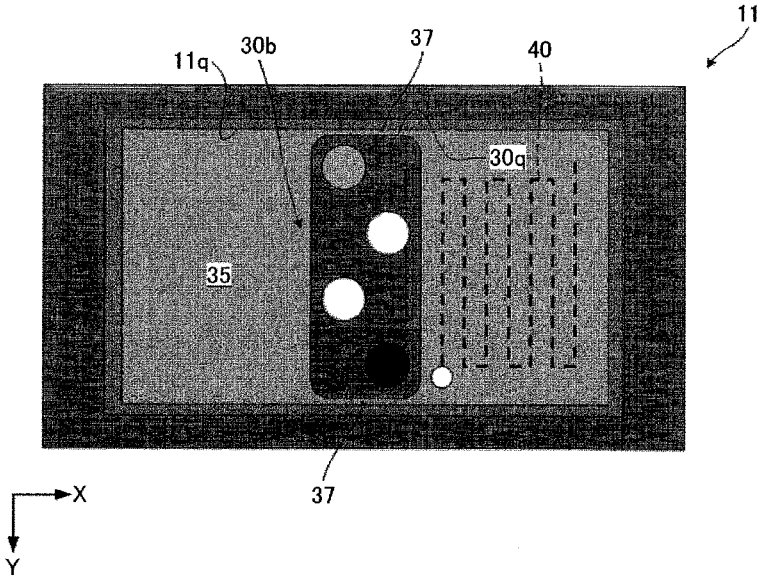
FIGS. 9A and 9B are schematic plan views illustrating the main part of another configuration example of the liquid-jet head illustrated in FIGS. 1A and 1B.

In the following, a description is given of various modifications of the configuration of the connecting part serving as the penetrating channel, and the recording liquid supply tube 30 associated with the connecting part, with reference to FIGS. 9A and 9B. In the configuration illustrated in FIG. 9A, the plural recording liquid supply tubes 30 in the above embodiment are illustrated as one integrated component. FIG. 9A illustrates the recording liquid supply tube 30 before construction, in which the tube part 30*b* is viewed from the downstream of the Z-axis direction (i.e., in the plus Z-axis direction).

In the configuration example, a communication part 37 is formed of an interval between an inner wall surface 11*q* of the housing 11 having the buffer chamber 35, and a side surface 30*q* of the tube part 30*b* facing the inner wall surface 11*q* and containing the recording liquid supply tube 30. The side surface 30*q* faces the inner wall surface 11*q* of the housing 11 having the buffer chamber 35 in a state in which the recording liquid supply tube 30 is constructed and the buffer chamber 35 is formed.

In FIG. 9A, the reference numeral 30*q* indicates a plane formed of an end surface of the tube part 30*b* downstream of the Z-axis direction (i.e., in the plus Z-axis direction). The plane 30*q* is a plane part directed toward the tube part 30*a* and connected to the tube part 30*a* in a state in which the recording liquid supply tube 30 is constructed. The plane 30*q* has a relatively large area and is easy to be flattened.

When the plane 30*q* is flattened, it may be easy to apply an adhesive material to the plane 30*q* serving as a flat surface using a thin film transferring process. Accordingly, it may be easy to acquire an ink sealing property and simplify a production process. The ink leakage may be prevented and the reliability of the liquid-jet head 107 may be improved by securing the ink sealing property. Note that the above-described configuration may also include a plane, though having a size smaller that that of the embodiment, corresponding to the plane 30*q*. Hence, the above-described advantages may be acquired to a less extent in this example.

The configuration of this example may also be provided with the connecting part 36. In the above-described configuration provided with the plural recording liquid supply tubes 30, the communication part 37 may be formed by providing an interval between the inner wall surface 11*q* and the circumferential surface of the recording liquid supply tube 30.

Figure 9B:
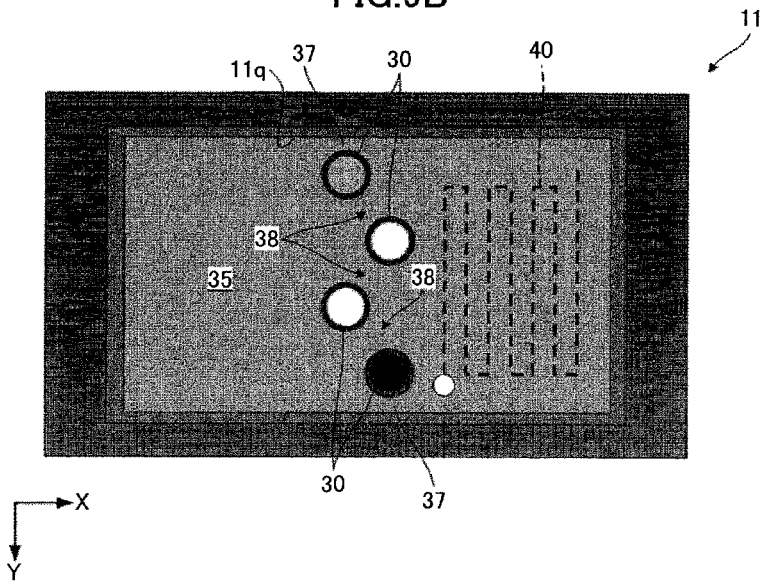

In the configuration example illustrated in FIG. 9B, the plural tube parts 30*b* respectively forming the plural recording liquid supply tubes 30 are formed of a flexible material such that the tube parts 30*b* are movable inside the buffer chamber 35. More specifically, the tube parts 30*b* may each be formed of flexible narrow tubes. An example of the flexible narrow tube may be a rubber tube; however, the flexible narrow tube may be formed of any other materials insofar as the material includes flexibility.

In this example, a connecting part 38 may be formed by providing an interval between the tube parts 30*b*. Further, the communication part 37 may also be formed by providing an interval between the tube part 30*b* and the inner wall surface 11*q*. Note that in this example, the buffer chamber 35 includes the spaces 35*a* and 35*b*. However, the buffer chamber 35 may be defined as one space.

In this configuration, the positional accuracy in the connection between the body 11*a* and the damper plate 11*b* may be low, and the production process may be simplified. That is, the tube parts 30*b* are formed of a flexible material such as a rubber tube, and thus the positions of the tube parts are flexible. Hence, it may be possible to connect the tube parts 30*b* to the tube parts 30*a*, respectively. The configuration of this example may also be provided with the connecting part 36.

An example of an inkjet recording apparatus having the liquid-jet head 107 as an inkjet recording head is described with reference to FIGS. 10 and 11. Note that FIG. 10 is a schematic side view illustrating an entire configuration of the inkjet recording apparatus, and FIG. 11 is a schematic plan view illustrating a part of the inkjet recording apparatus.

An inkjet recording apparatus 100 serves as an inkjet printer that is a digital printing apparatus capable of forming full-color images. The inkjet recording apparatus 100 is configured to perform an image forming process based on image signals corresponding to image information received from outside the inkjet recording apparatus 100.

The inkjet recording apparatus 100 may be capable of forming an image on sheet type recording media including standard paper generally used for copying, an overhead projector (OHP) sheet, thick paper such as a card or postcard, and an envelop. A sheet 112 serving as a recording sheet of the recording medium may be cloth or the like, and the inkjet recording apparatus 100 may be used in an industrial system for a textile printer. The inkjet recording apparatus 100 may be a single side image forming apparatus capable of forming an image only on one side of the sheet 112 serving as a recording medium subject to printing; however, the inkjet recording apparatus 100 may be a double side image forming apparatus capable of forming images on two sides of the sheet 112.

The inkjet recording apparatus 100 includes the liquid-jet head 107 configured to discharge ink with respective colors of yellow (Y), cyan (C), magenta (M), and black (Bk).

The inkjet recording apparatus 100 further includes a carriage 103 including the liquid-jet head 107 provided with sub-tanks 108 of respective colors serving as recording liquid supply parts configured to supply respective colors of ink to the liquid-jet head 107. In the carriage 103, the liquid-jet head 107 is downwardly attached such that ink discharge directions of the liquid-jet head 107 are downwardly directed. In the inkjet recording apparatus 100, the carriage 103 is disposable in a direction orthogonal to paper in FIG. 10. Further, the inkjet recording apparatus 100 includes a guide rod 101 and a guide rail 102 slidably disposed in a main-scanning direction corresponding to a horizontal direction in FIG. 11, and not-illustrated left and right side plates supporting the guide rod 101 and the guide rail 102.

The inkjet recording apparatus 100 further includes a timing belt 105 to which the carriage 103 is fixed and configured to move the carriage 103 to scan in the main scanning direction, and a main scanning motor 104 configured to drive the timing belt 105. The inkjet recording apparatus 100 further includes a not-illustrated ink supply tube for supplying ink to the sub-tank and an ink cartridge serving as a main tank to supply supplementary ink to the sub-tank 108 via the ink supply tube.

The inkjet recording apparatus 100 further includes a paper cassette 110 having a sheet stacking part 111 formed of a platen on which sheets 112 are stacked. The inkjet recording apparatus 100 further includes a feed roller 113 formed of a semicircular roll sheet feeding member configured to individually separate each of the sheets 12 from the sheet stacking part 111. The feed roller 113 serves as a member forming a sheet feeder for feeding the sheets 112 stacked on the sheet stacking part 111. The inkjet recording apparatus 100 further includes a separating pad 114 formed of a material having a high frictional coefficient. The separating pad 114 faces the feed roller 113 and force is applied on the feed roller 113 side of the separating pad 114.

The inkjet recording apparatus 100 further includes a transfer belt 121 formed of an endless belt configured to electrostatically attract the sheets 112. The transfer belt 121 serves as a member forming a transfer part for transferring the sheets 112 at the lower part of the liquid-jet head 107. The inkjet recording apparatus 100 further includes a guide member 115 configured to guide each of the sheets 112 fed from the sheet feeder toward the transfer belt 121. The guide member 115 serves as a member forming the transfer part.

The inkjet recording apparatus 100 further includes a counter roller 122 for transferring each of the sheets 112 transferred from the sheet feeder via the guide member 115 by sandwiching the sheet 112 between the transfer belt 121 and the counter roller 122. The inkjet recording apparatus 100 further includes a transfer guide 123 configured to change the direction of each of the sheets 112 transferred toward a vertically upward direction by the counter roller 122 by 90 degrees, and place each of the sheets 112 on the transfer belt 121. The transfer guide 123 serves as a member forming the transfer part.

The inkjet recording apparatus 100 further includes an edge pressure application roll 125 configured to apply pressure to each of the sheets 112 placed on the transfer guide 123 to follow the transfer belt 121. The edge pressure application roll 125 serves as a member forming the transfer part. The inkjet recording apparatus 100 further includes a presser member 124 configured to apply pressure to the edge pressure application roll 125 toward the transfer belt 121 side. The presser member 124 serves as a member forming the transfer part.

The inkjet recording apparatus 100 further includes a charging roller 126 serving as a charging unit configured to contact a surface layer of the transfer belt 121. The charging roller 126 is configured to receive pressure of 2.5 N by each of the ends of the charging roller 126 and configured to be rotationally driven along with the rotation of the transfer belt 121. The charging roller 126 serves as a member forming the transfer part. The inkjet recording apparatus 100 further includes a not-illustrated high voltage power supply configured to alternately apply a voltage to the charging roller 126 to alternately discharge a plus output and a minus output repeatedly. The charging roller 126 serves as a member forming the transfer part.

The inkjet recording apparatus 100 further includes a transfer roller 127 and a tension roller 128 over both of which the transfer belt 121 is looped. The transfer roller 127 and the tension roller 128 serve as members forming the transfer part.

Figure 10:
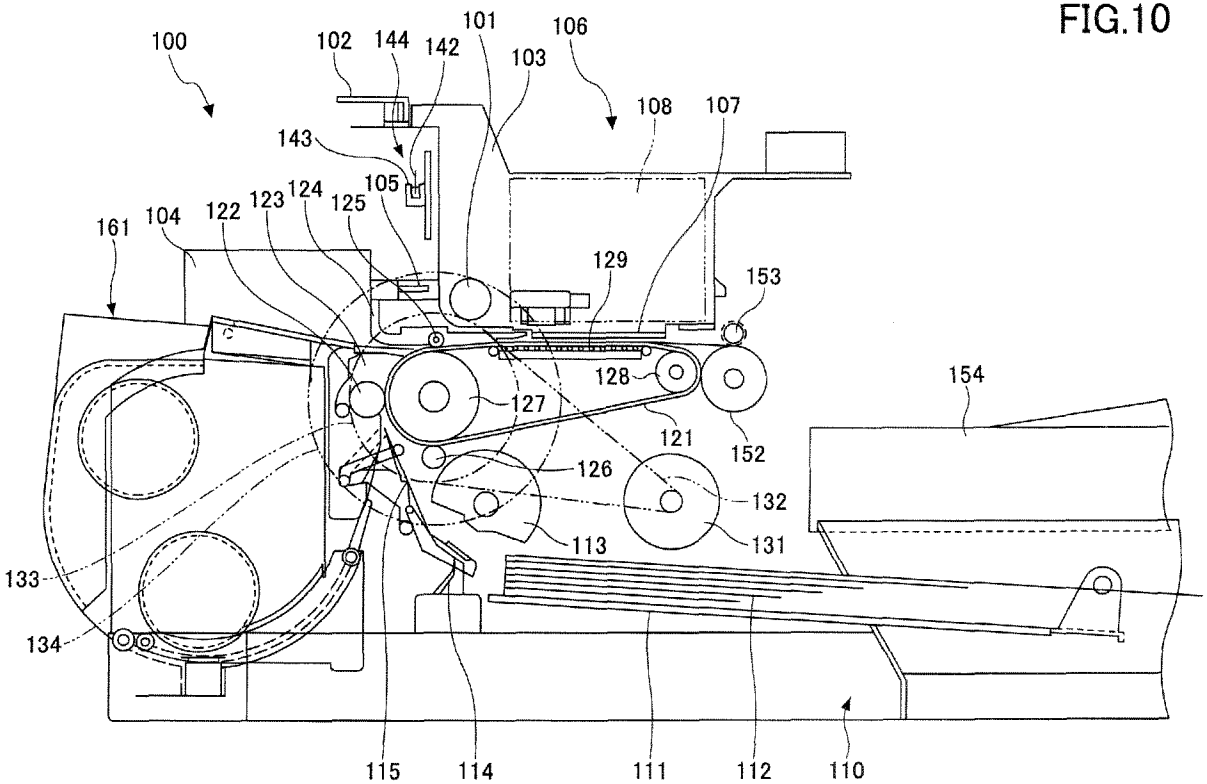
FIG. 10 is a schematic side view illustrating a liquid-jet device having the liquid-jet head illustrated in FIGS. 1A and 1B, and an image forming apparatus having the liquid-jet device.
Figure 11:
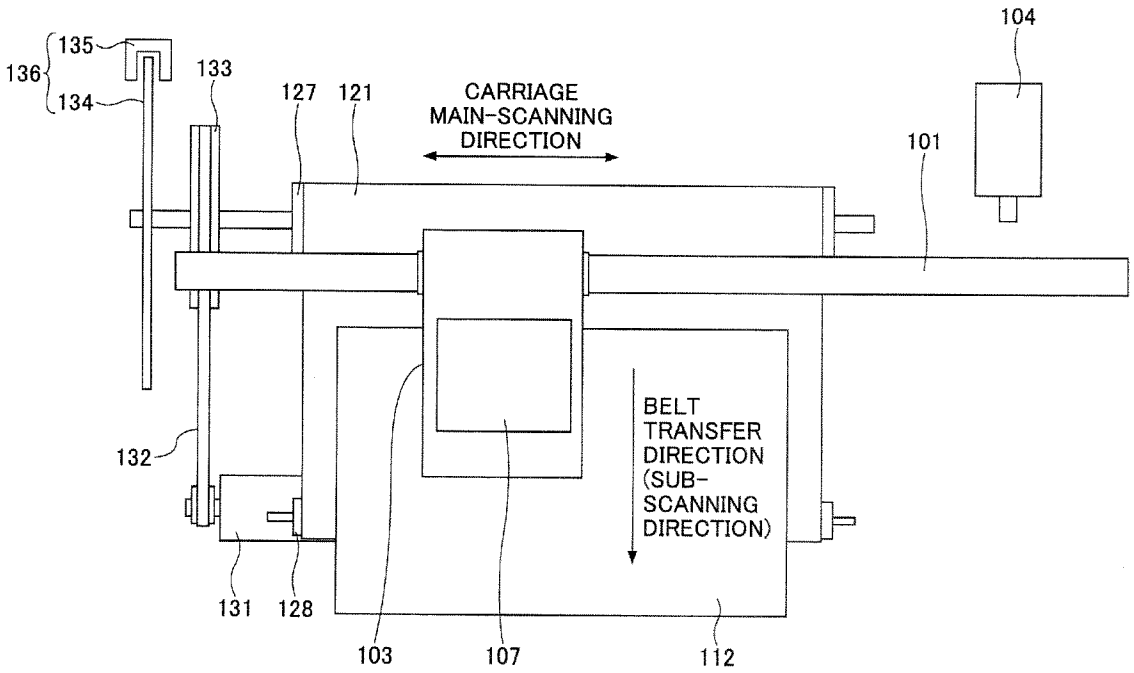
FIG. 11 is a schematic plan view illustrating a part of the image forming apparatus illustrated in FIG. 10.

The inkjet recording apparatus 100 further includes a sub-scanning motor 131 serving as a driving source configured to rotationally drive the transfer belt 121 in a sub-scanning direction that is a belt transfer direction corresponding to a clockwise direction in FIG. 10, and corresponding to a downward direction in FIG. 11. The sub-scanning motor 131 serves as a member forming the transfer part. The inkjet recording apparatus 100 further includes a timing belt 132 and a timing roller 133 configured to transmit rotational drive force of the sub-scanning motor 131 to the transfer roller 127 such that the transfer belt 121 revolves in the sub-scanning direction. The timing belt 132 and the timing roller 133 serve as members forming the transfer part.

The inkjet recording apparatus 100 further includes a guide member 129 disposed on a rear side of the transfer belt 121 corresponding to an image forming region in which an image is formed by the liquid-jet head 107. The guide member 129 serves as a member forming the transfer part. The inkjet recording apparatus 100 further includes an encoder 136 including a slit disk 134 attached to a shaft of the transfer roller 127 and a sensor 135 configured to detect slits of the slit disk 134. The encoder 136 serves as a member forming the transfer part.

The inkjet recording apparatus 100 further includes an encoder 144 disposed on a left side (i.e., a front side) of the carriage 103 in FIG. 10 and configured to detect a main-scanning direction position of the carriage 103, that is, a position with respect to a home position. The encoder 144 serves as a member forming the transfer part. The inkjet recording apparatus 100 further includes an encoder scale 142 having slits and an encoder sensor 143 formed of a transmission photosensor configured to detect the slits of the encoder scale 142. The encoder scale 142 and the encoder sensor 143 serve as members forming the encoder 144.

The inkjet recording apparatus 100 further includes a not-illustrated separator for separating the sheet 112 from the transfer belt 121. The separator serves as a member forming a sheet output part for outputting the sheet 112 on which an image is recorded by the liquid-jet head 107.

The inkjet recording apparatus 100 further includes a sheet output roller 152 and a sheet output roll 153 configured to transfer the sheet 112 separated by the separator from the transfer belt 121. The sheet output roller 152 and the sheet output roll 153 serve as members forming the sheet output part. The inkjet recording apparatus 100 further includes a sheet receiving tray 154 configured to retain the sheets 112 output by the sheet output part.

The inkjet recording apparatus 100 further includes a removably attached double side sheet feeding unit 161 configured to capture the sheet 112 returned by a reverse revolution of the transfer belt 121, reverse the returned sheet 112 and feed the reversed sheet 112 to an interval between the counter roller 122 and the transfer belt 121 again. The inkjet recording apparatus 100 further includes a control circuit serving as a control unit having a central processing unit (CPU), memory, and the like and configured to control overall operations of each configuration.

In the inkjet recording apparatus 100 having the above configuration, each of the sheets 112 is fed by being separated from the sheet feeder, the sheet 112 fed in a vertically upward direction is guided by the guide member 115, and the guided sheet 112 is then transferred by being sandwiched between the transfer belt 121 and the counter roller 122. The edge of the thus transferred sheet 112 is further guided by the transfer guide 123, the edge of the transferred sheet 112 is pressed by the edge pressure application roll 125 against the transfer belt 121, and its transfer direction is changed approximately by 90 degrees.

At this time, the voltage is alternately applied by the control circuit from the high voltage power supply to the charging roller 126 such that the transfer belt 121 is charged with an alternate charged voltage pattern; that is, the transfer belt 121 is alternately charged with a plus voltage and a minus voltage each pattern having a belt-like predetermined width in the sub-scanning direction corresponding to a revolving direction. When the sheet 112 is fed onto the transfer belt 121 alternately charged with the plus and minus voltages, the sheet 112 is electrostatically attracted on the transfer belt 121. Accordingly, the sheet 121 is transferred in the sub-scanning direction by the transfer belt 121 traveling in a circumferential direction.

At this position, the carriage 103 is moved in the main-scanning direction to drive the liquid-jet head 107 based on an image signal, which causes the liquid-jet head to discharge ink on the stationary sheet 112 to make a record of one line. Thereafter, the sheet 112 on which one line is recorded is transferred in a predetermined amount for making a record of a next line.

On receiving a recording end signal or a signal indicating that a rear end of the sheet 112 has reached the recording region, the inkjet recording apparatus 100 stops recording operations, and outputs the sheet 112 onto the sheet receiving tray 154.

In duplex printing, when recording of a first surface (initially printing surface) of the sheet 112 is completed, the recorded sheet 112 is fed inside the double side sheet feeding unit 161 by reversing the revolving direction of the transfer belt 121. The double side sheet feeding unit 161 reverses the fed sheet 112 such that a rear surface (a second surface) is positioned as a printing surface, and the sheet 112 positioned in this state is fed in an interval between the counter roller 122 and the transfer belt 121. The sheet 112 is transferred onto the transfer belt 121 in a manner similar to the above-described case by performing timing control, where a record is made on the rear surface of the sheet 112. The sheet 112 having now the recorded rear surface is output on the sheet receiving tray 154.

Since the inkjet recording apparatus 100 having the above configuration includes the liquid-jet head 107 having the simplified structure and exhibiting the low production cost, the inkjet recording apparatus 100 may exhibit low production cost as a whole.

In the inkjet recording apparatus 100 according to the embodiment, a liquid-jet device 106 is formed of the sub-tank 108 and the liquid-jet head 107. However, the sub-tank 108 may be omitted from the inkjet recording apparatus 100 according to the embodiment. In such a case where the sub-tank 108 is omitted from the inkjet recording apparatus 100, the liquid-jet device 106 includes an ink cartridge as the recording liquid supply part. Alternatively, the liquid-jet device 106 may include the sub-tank 108 and the ink cartridge as the recording liquid supply part.

Although the preferred embodiments are described above, the present invention is not limited to the above-described embodiments and modifications.

Unless otherwise specified in the above description, various alterations and modifications may be made without departing from the scope of the invention.

For example, the image forming apparatus according to the embodiments may be any one of a printer, a facsimile machine, and a copier, or a multifunctional apparatus having a combination of two or more of these functions. In addition, the embodiments and modifications may be applied to a liquid-jet head configured to discharge a liquid other than ink as a recording liquid such as a DNA specimen, resist, a pattern material and the like, a liquid-jet device having the liquid-jet head, and an image forming apparatus having the liquid-jet head and the liquid-jet device.

As described above, the image forming apparatus to which the embodiments and the modifications are applied is not limited to the image forming apparatus of the type illustrated in FIG. 10, but may be other types of the image forming apparatus, that is, a copier or a facsimile machine as a single unit, or a multifunctional apparatus having a combination of these functions, a multifunctional apparatus of a monochrome type, an image forming apparatus used for forming an electric circuit, or an image forming apparatus for forming predetermined images in a biotechnological field.

According to one aspect of the embodiment, there is provided a liquid-jet head that includes a plurality of nozzles disposed in a predetermined direction and configured to discharge a recording liquid; a plurality of individual liquid chambers connected to the respective nozzles and configured to supply the recording liquid to the respective nozzles; a common liquid chamber connected to the individual liquid chambers and configured to supply the recording liquid to the individual liquid chambers; an air reservoir space disposed adjacent to the common liquid chamber and configured to retain air; a flexible division wall separating the common liquid chamber from the air reservoir space; a tube unit connected outside the liquid-jet head; a recording liquid supply tube passing through the air reservoir space to divide the air reservoir space into a plurality of spaces and configured to supply the recording liquid to the common chamber; and a connecting unit configured to connect the divided spaces to one another.

Accordingly, the liquid-jet head having a damper function of the common liquid chamber and a simplified structure may be provided.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

The present application is based on and claims the benefit of priority of Japanese Priority Application No. 2012-171999 filed on Aug. 2, 2012, the entire contents of which are hereby incorporated by reference.

What is claimed is:

1. A liquid-jet head comprising:

a plurality of nozzles disposed in a predetermined direction and configured to discharge a recording liquid;

a plurality of individual liquid chambers connected to the respective nozzles and configured to supply the recording liquid to the respective nozzles;

a common liquid chamber connected to the individual liquid chambers and configured to supply the recording liquid to the individual liquid chambers;

an air reservoir space disposed adjacent to the common liquid chamber and configured to retain air;

a flexible division wall separating the common liquid chamber from the air reservoir space;

a tube unit connected outside the liquid-jet head;

a recording liquid supply tube passing through the air reservoir space to divide the air reservoir space into a plurality of spaces and configured to supply the recording liquid to the common chamber; and a connecting unit configured to connect the divided spaces to one another.

2. The liquid-jet head as claimed in claim 1, wherein the connecting unit is formed of a recess formed such that a diameter of the recording liquid supply tube is reduced.

3. The liquid-jet head as claimed in claim 2, wherein the recording liquid supply tube includes a first tube part connected to the common liquid chamber, and a second tube part connected to the first tube part for forming the recording liquid supply tube, and wherein the recess is formed of a step formed at least in one of the first tube part and the second tube part.

4. The liquid-jet head as claimed in claim 1, wherein the connecting unit is formed of an interval between an inner wall surface forming the air reservoir space and the recording liquid supply tube.

5. The liquid-jet head as claimed in claim 1, further comprising:

a plurality of the recording liquid supply tubes, wherein the connecting unit is formed of at least one of intervals between the recording liquid supply tubes.

6. The liquid-jet head as claimed in claim 4, wherein the recording liquid supply tubes are movable within the air reservoir space.

7. The liquid-jet head as claimed in claim 1, wherein the recording liquid supply tube includes a first tube part connected to the common liquid chamber, and a second tube part connected to the first tube part for forming the recording liquid supply tube, wherein the second tube part includes a side surface facing an inner wall surface forming the air reservoir space in a state where the recording liquid supply tube is formed, and is directed toward the first tube part in the state where the recording liquid supply tube is formed, and wherein the connecting unit is formed of an interval between the recording liquid supply tube and the side surface.

8. A liquid-jet device, comprising:

the liquid-jet head as claimed in claim 1; and a recording liquid supply unit connected to the recording liquid supply tube and configured to supply a recording liquid to the liquid-jet head.

9. An image forming apparatus, comprising:

one of the liquid-jet head as claimed in claim 1 and the liquid-jet device as claimed in claim 8.

* * * * *